US006401407B1

(12) United States Patent
Humphrey

(10) Patent No.: US 6,401,407 B1
(45) Date of Patent: Jun. 11, 2002

(54) COVER PLATE GROUND ANCHOR

(75) Inventor: Doy T. Humphrey, Peoria, AZ (US)

(73) Assignee: Stay-Put Safety Plate Distribution, Inc., Phoenix, AZ (US)

( * ) Notice: Subject to any disclaimer, the term of this patent is extended or adjusted under 35 U.S.C. 154(b) by 0 days.

(21) Appl. No.: 09/318,992

(22) Filed: May 26, 1999

(51) Int. Cl.[7] ..... E02D 5/74

(52) U.S. Cl. ..... 52/155; 52/19; 52/153; 52/154; 52/161

(58) Field of Search ..... 52/19, 153, 154, 52/155, 161

(56) References Cited

U.S. PATENT DOCUMENTS

| | | | |
|---|---|---|---|
| 1,807,488 | A | 5/1931 | Michalicek |
| 2,755,734 | A | 7/1956 | Smith |
| 2,811,839 | A | 11/1957 | McReynolds, Jr. |
| 3,287,920 | A | 11/1966 | Oitto, Jr. |
| 3,420,013 | A | 1/1969 | Alvarado |
| 3,803,782 | A | 4/1974 | Ballew |
| 3,803,783 | A | 4/1974 | Ballew |
| 4,095,431 | A | 6/1978 | Hannan |
| 4,189,891 | A | 2/1980 | Johnson et al. |
| 4,251,963 | A | 2/1981 | Patterson |
| 4,453,845 | A | 6/1984 | Donan, Jr. |
| 4,685,830 | A | 8/1987 | Ford |
| 4,911,586 | A | 3/1990 | Kelley et al. |
| 5,108,068 | A | 4/1992 | Gingras |
| 5,203,127 | A | 4/1993 | Olthoff et al. |
| 5,417,519 | A | 5/1995 | Smuts |

*Primary Examiner*—Beth A. Stephan
(74) *Attorney, Agent, or Firm*—Fennemore Craig; Richard E. Oney; Susan Stone Rosenfield

(57) ABSTRACT

The present invention provides an earth anchor to secure a cover over a trench or hole in the ground. The device has a retaining cap which is attached to a rod. Extendible arms are connected to the rod below the cap. The end of the rod opposite the cap is inserted into the hole or trench until the cap rests at ground level, either on separate cover plates or on the ground itself. For large holes, the cap retains separate cover plates over the hole; for small holes, the cap acts as a cover itself. The arms are extended by a jack screw, rack and pinion, or other means until they contact the substrate or underside of the cover plates and clamp the same between the cap and the arms. The cover can be removed by reversing the motion of the jack screw or rack and pinion, and retracting the arms, thereby freeing the device to be removed from the whole.

29 Claims, 9 Drawing Sheets

FIG. 3
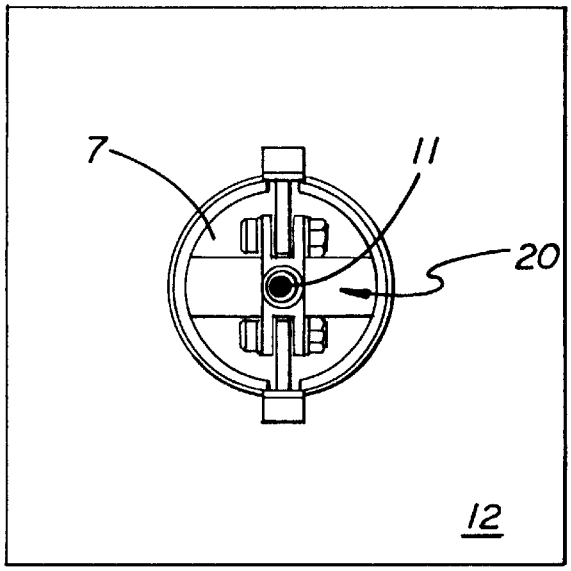
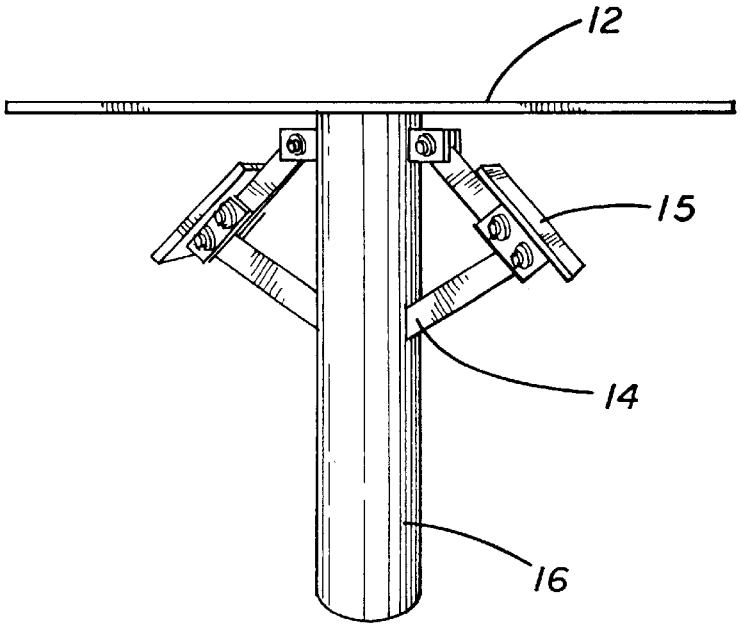
FIG. 4

COVER PLATE GROUND ANCHOR

BACKGROUND OF INVENTION

This invention relates generally to an apparatus for removably securing structures to the ground. More specifically, this invention relates to an anchor for removably securing a cover over a trench or hole in the ground.

Access holes are dug in the street or right-of-way to access and locate underground utilities. If the hole must be left unfilled for continuing work the next day or for later inspection, the common practice is to place one or more heavy cover plates of 0.5"–1.25" steel over the opening in the ground. The cover plates are held in place simply by their sheer weight. Despite the weight, however, the plates may be dislodged by traffic, vibration, or vandalism, leaving an opening in the ground that is dangerous to vehicles, people, and pets who pass by. Material loosened while digging the trench can thus also be exposed, flying into and breaking vehicle windshields. In locations where a plate is likely to be dislodged or must be left for a longer period of time, tar or asphalt is often laid around the perimeter of the cover to further secure it in place. This method is somewhat more secure, but requires additional effort, equipment and materials and makes intentional plate removal messy and more difficult. It is desirable to have a device for securing covers over access holes and trenches.

Holes and trenches come in many shapes, sizes and substrate materials. Holes may be circular or square. Trenches may cut a straight path, or have curves or corners. Some trenches and holes have straight vertical walls, while the walls are sloped in others. The substrate into which the hole or trench is cut may be composed of hard material like rock, or softer material like dirt or sand, into which it is difficult to anchor. For openings cut in asphalt or concrete, the cavity below the opening may undercut the opening, leaving an overhang of asphalt or concrete. A device used to secure covers over these openings must accommodate all sizes and shapes of trenches and holes, as well as a variety of substrate materials.

It is an object of this invention to provide a device which removably secures a cover to the ground. It is another object of this invention to provide a device which secures one or more cover plates to the ground in a way that prevents the cover from being inadvertently dislodged. It is another object of this invention to secure a cover to the ground in a way that it can be easily removed to inspect the hole or trench, or to backfill when work or inspection is complete. It is another object of this invention to provide a device which removeably secures the cover to asphalt, concrete, soil or other surface material. Another object is to provide an anchoring device that is weather resistant.

BRIEF SUMMARY OF THE INVENTION

The present invention provides an earth anchor to secure a cover over a trench or hole in the ground. The device has a retaining cap which is attached to a rod. Extendible arms are connected to the rod below the cap. The end of the rod opposite the cap is inserted into the hole or trench until the cap rests at ground level, either on top of a cover plate or on the ground itself. For large holes, the cap retains separate cover plates over the hole; for small holes, the cap acts as a cover itself. The arms are extended by a jack screw, rack and pinion, or other means until they contact the substrate or underside of the cover plates and clamp the same between the cap and the arms. The cover can be removed by reversing the motion of the jack screw or rack and pinion, and retracting the arms, thereby freeing the device to be removed from the hole.

BRIEF DESCRIPTION OF THE DRAWING

FIG. 3 is a top view of the first embodiment of the invention.

FIG. 4 is a side view of the first embodiment of the invention, showing the hinged arms partially extended by means of a jack screw.

DESCRIPTION OF THE PREFERRED EMBODIMENTS

Figure 1:
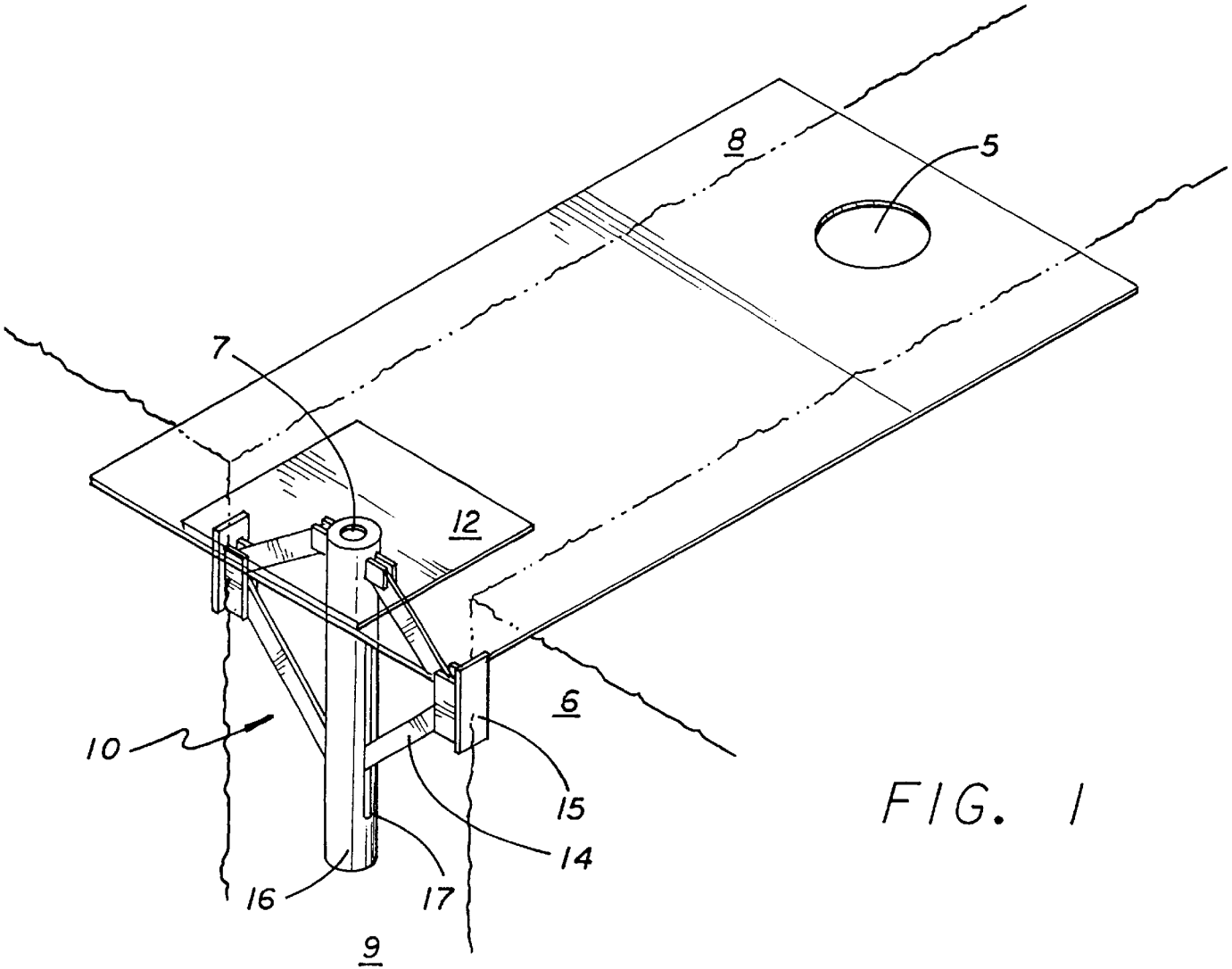
FIG. 1 is a perspective view of the first embodiment of the device employed in a trench, securing a cover plate to the ground over the trench.
Figure 2:
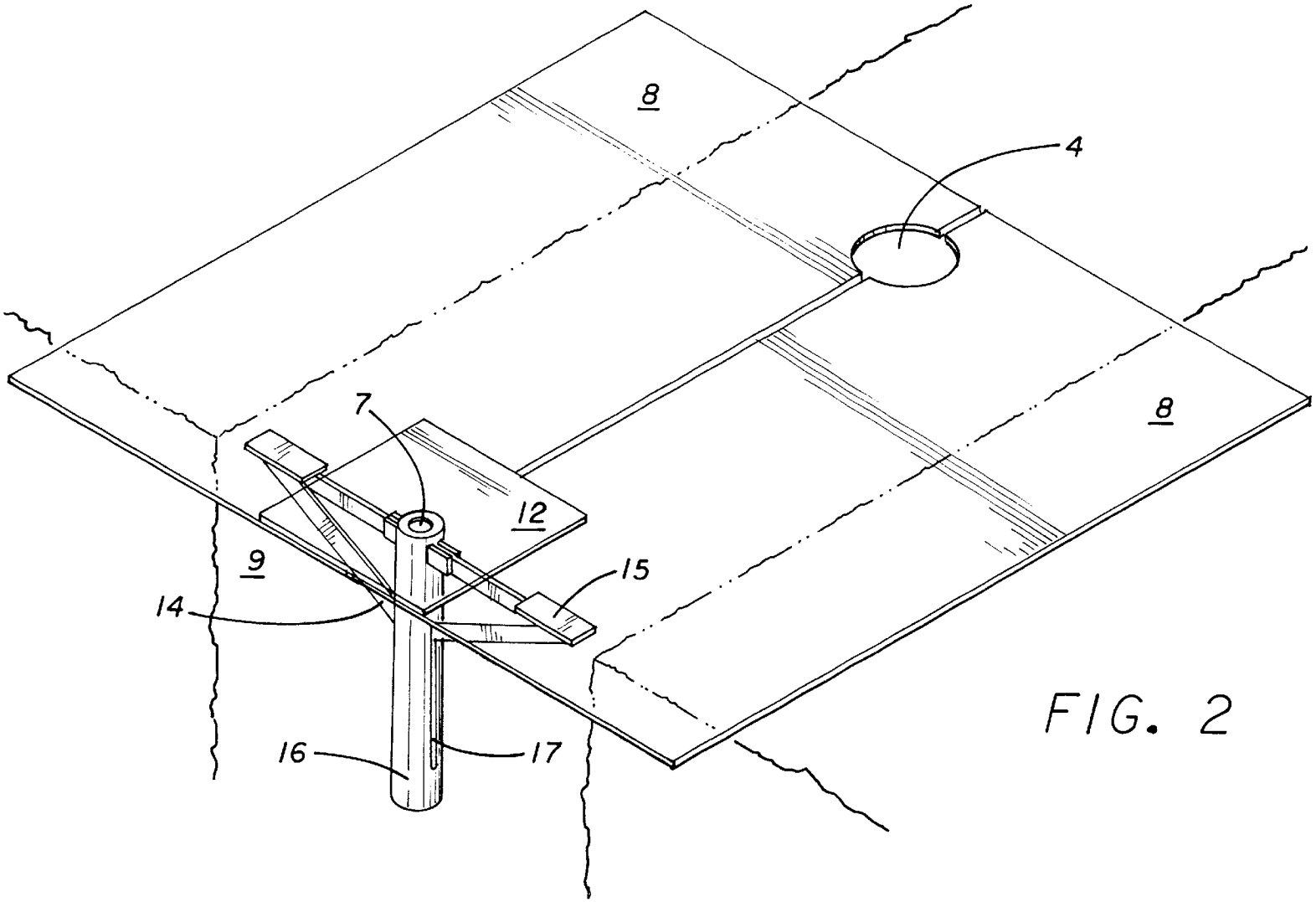
FIG. 2 is a perspective view of the first embodiment of the device employed in a trench, securing cover plates to each other over the trench.

This invention is best understood by reading the following description in conjunction with reference to the accompanying FIGS. 1–10 in which like numerals refer to like parts throughout the drawings. FIG. 1 shows a first embodiment of the device, indicated generally as 10, installed in a trench 9, wherein the device serves to secure one or more cover plates to the ground. The device 10 is shown securing a cover plate 8 to the ground 6 so that the cover plate 8 does not lift up or otherwise become dislodged by traffic, vibration or vandalism. The device 10 is installed by inserting it through an aperture 5 in the cover plate 8 or, alternatively, abutting the edge of a cover plate, if no aperture is available, so that the lower portion of the device is suspended. An aperture 5 in the body of the cover plate 8 is shown at the distal end of the cover plate in FIG. 1. (The aperture in the proximal end of the cover plate is hidden in the figures by the cap 12.) An aperture 4 in the edge of the cover plate 8 is shown in FIG. 2. A cap 12 rests on top of the cover plate 8.

As shown in FIG. 3, an aperture in the cap 12 allows access to the end of a rod 11, which is connected to the cap 12 in a manner which allows the rod to turn independently of the cap 12. At least one extendible arm 14 is slidably connected to the rod 11 so that when the rod is turned, the arm moves through a range of positions from a position substantially parallel to the rod to substantially perpendicular to the rod 11. A jack screw or rack and pinion system is used to extend the arms, as described below. The arm 14 is extended until it contacts or penetrates the ground 6. More than one arm 14 may be used to accommodate different trench sizes and cover plate configurations. Preferably two arms are used to secure a cover plate 8 over a hole or trench, the arms positioned opposite each other on the rod 11, as shown in FIG. 1. A foot 15 is attached to each arm 14 to engage the ground more securely than the arm alone. The foot may be pivotally attached to the arm. Projections, or teeth, are added to the foot 15 to enable the foot 15 to better secure the anchor to the ground. When the device is to be removed, the rod 11 is turned in a reverse direction so that the arms retract.

The rod 11 can be attached to the cap 12 in any way which allows the cap 12 to float, i.e., the rod 11 turns while the cap 12 remains in place. A modified H-beam structure, indicated generally as 20, is shown in FIGS. 3, 5, 6, and 7. Preferably the rod 11 does not extend above the cap 12 because a relatively smooth cap surface is desired so that vehicles driving over the cap 12 will have a smooth ride and tires will not be damaged. The edges of the cap 12 may be beveled to make the transition from the cap 12 to the ground or cover place more smooth. The rod 11 is encased in a tube 16, having a slot 17 along the lengthwise axis of the tube to accommodate each arm as it extends through its full range of positions. The tube 16 is also attached to the cap 12. The tube 16 adds structural integrity to the device, which must be rugged enough to survive heavy traffic for extended periods of time, and helps keep the means for extending the arms free of dirt and debris. If desired, a locking mechanism can be used to prevent the rod 11 from being turned by unauthorized personnel, thereby preventing the anchor from being removed and preventing dangerous situations from arising due to an uncovered hole or trench.

FIG. 2 shows the device 10 securing together two cover plates 8 used to cover the trench 9 to prevent objects or animals from falling in. Instead of clamping the cover plate 8 to the ground, as shown in FIG. 1, the device clamps the cover plate 8 to another cover plate 8. Like the first embodiment above, the device 10 effectively secures the cover plate 8 to the ground so that it does not lift up or otherwise become dislodged by traffic, vibration or vandalism. Of course, a combination of the first embodiment and second embodiment may be utilized in the field, wherein one arm engages the ground and another arm engages another cover plate.

Figure 8:
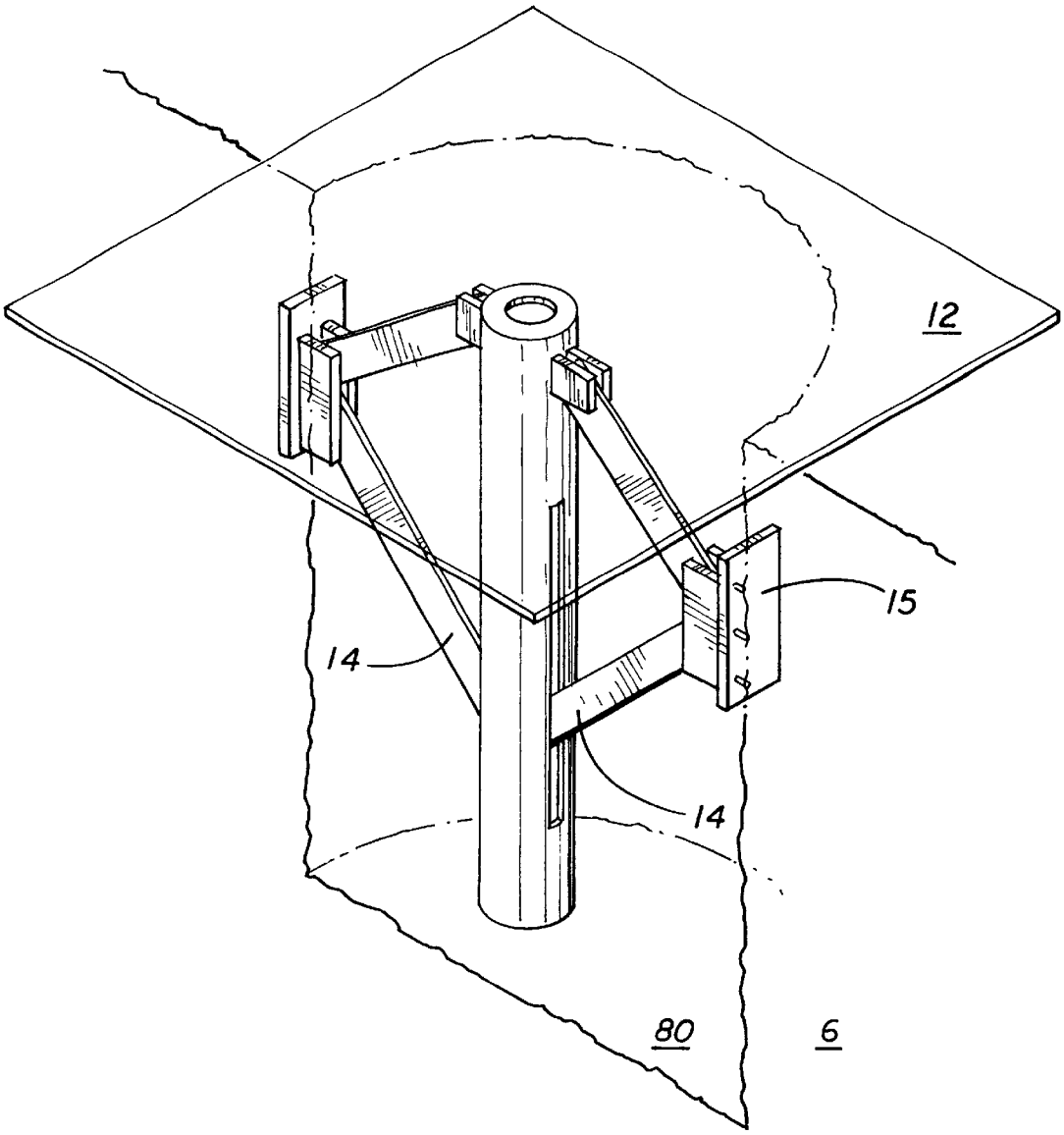
FIG. 8 illustrates a second embodiment of the device employed in a hole, showing use of the cap itself as the cover for the hole.

FIG. 8 shows a second embodiment of the device 10, employed as the cover for a hole having an opening smaller than the cap 12. The device is lowered into the hole 30 until the cap 12 rests on the ground 6. The arms 14 are extended until they engage the ground 6 or, in a hole where the cavity has undercut the pavement, the arms clamp the cap 12 to the overhanging substrate.

Figure 5:
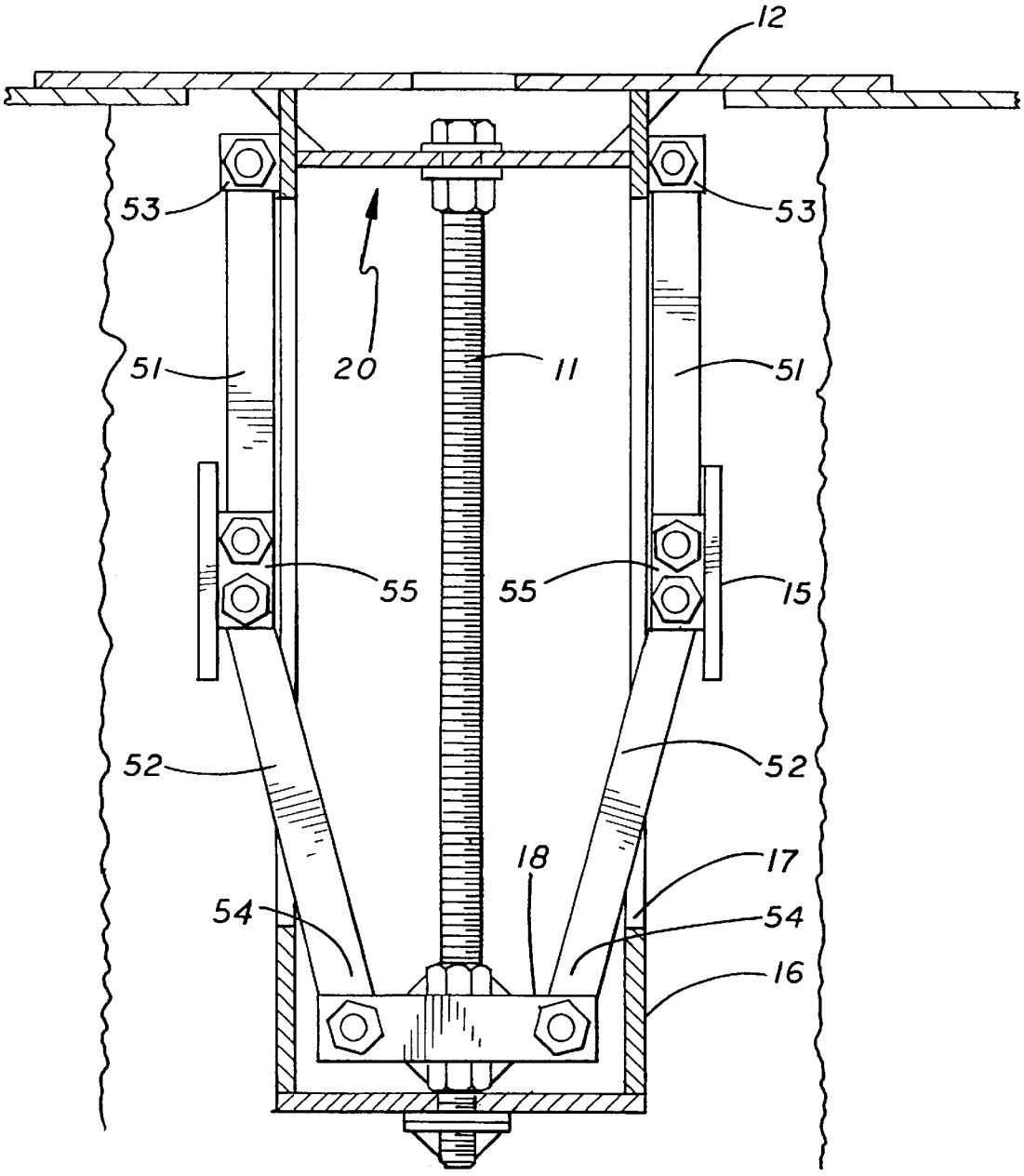
FIG. 5 is a cross-section view of the first embodiment of the invention, showing the hinged arms in a closed position substantially parallel to the jack screw.

To implement the ground anchor, the arms must be extended. Several means are available for transforming the circular motion of the turning rod 11 into an extension motion of the arm. FIGS. 1–5 and 8 show the present invention utilizing an externally threaded rod 11 in combination with an internally-threaded collar (hidden behind the cross-member 18 in the Figures) attached to hinged arms. The end of the rod 11 that is accessible through the cap 12 is configured to make the rod 11 easy to turn. For example, the end may be shaped to receive a flathead or Phillips screwdriver, an Allen wrench, or it may be shaped as a hexnut so that it can be easily turned with a lug wrench. When the rod 11 is turned in a forward direction, the collar follows the threads, causing it to move up the rod 11, thereby extending the arms. When the device is to be removed, the rod 11 is turned in a reverse direction so that the arms retract. This configuration is commonly known as a jack screw. Refer to FIG. 5 which most clearly illustrates an embodiment with hinged arms. Each arm has two links, a first link 51 and a second link 52. One end of each link is pivotally attached to a flange on the foot 15, creating a single hinged arm having two links. The foot 15 is the point that is farthest from the rod 11 when the arm is extended. The free end 53 of the first link 51 is pivotally attached near the top of the rod 11 or tube 16. The free end 54 of the second link 52 is attached to the collar. When the rod 11 is turned in a forward direction, the collar follows the threads, causing it to move up the rod 11 and closing the hinge point, thereby extending the arms. FIG. 4 shows the arms in an extended position. When the rod 11 is turned in a reverse direction, the collar moves down the rod 11 and opens the hinge point, thereby collapsing the arms. FIG. 5 shows the arms in a collapsed position.

Figure 6:
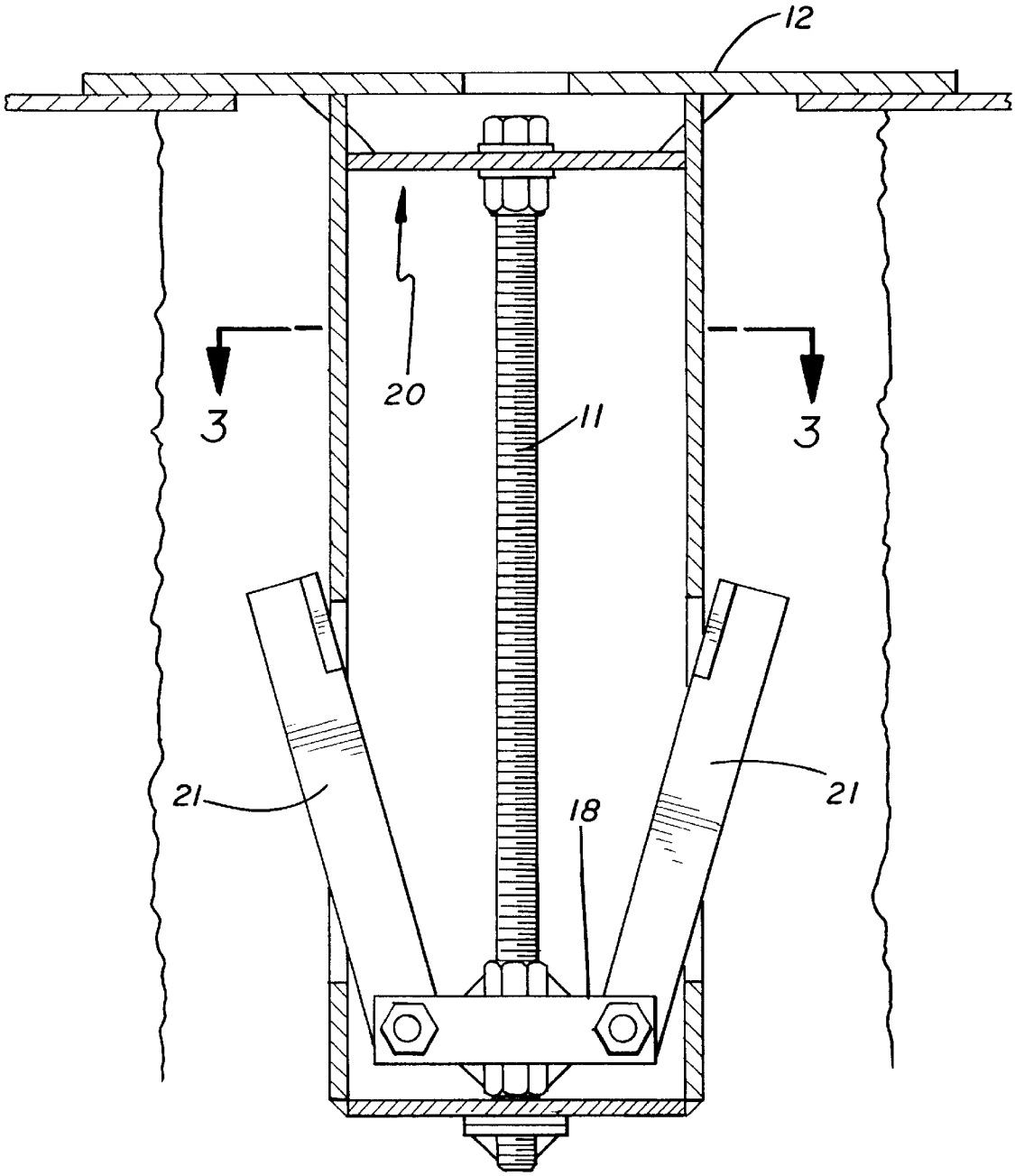
FIG. 6 is a side view of the first embodiment of the invention, showing the straight arms in a closed position.

FIG. 6 shows an embodiment with straight arms. One end of each arm 21 is pivotally attached to the collar (again, hidden behind the cross-member 18 in the Figures). When the rod 11 is turned in a forward direction, the collar follows the threads, causing it to move up the rod 11 and causing the arms to move from a position substantially parallel to the rod 11 to a position substantially perpendicular to the rod 11. When the rod 11 is turned in a reverse direction, the collar moves down the rod 11 and the arms are collapsed. Multiple arms can be attached to the collar, so that the jack screw can operate more than one arm simultaneously. However, some situations may require that a single arm be used to secure the device in place, in which case the unused arm may hang suspended in mid-air.

Figure 7:
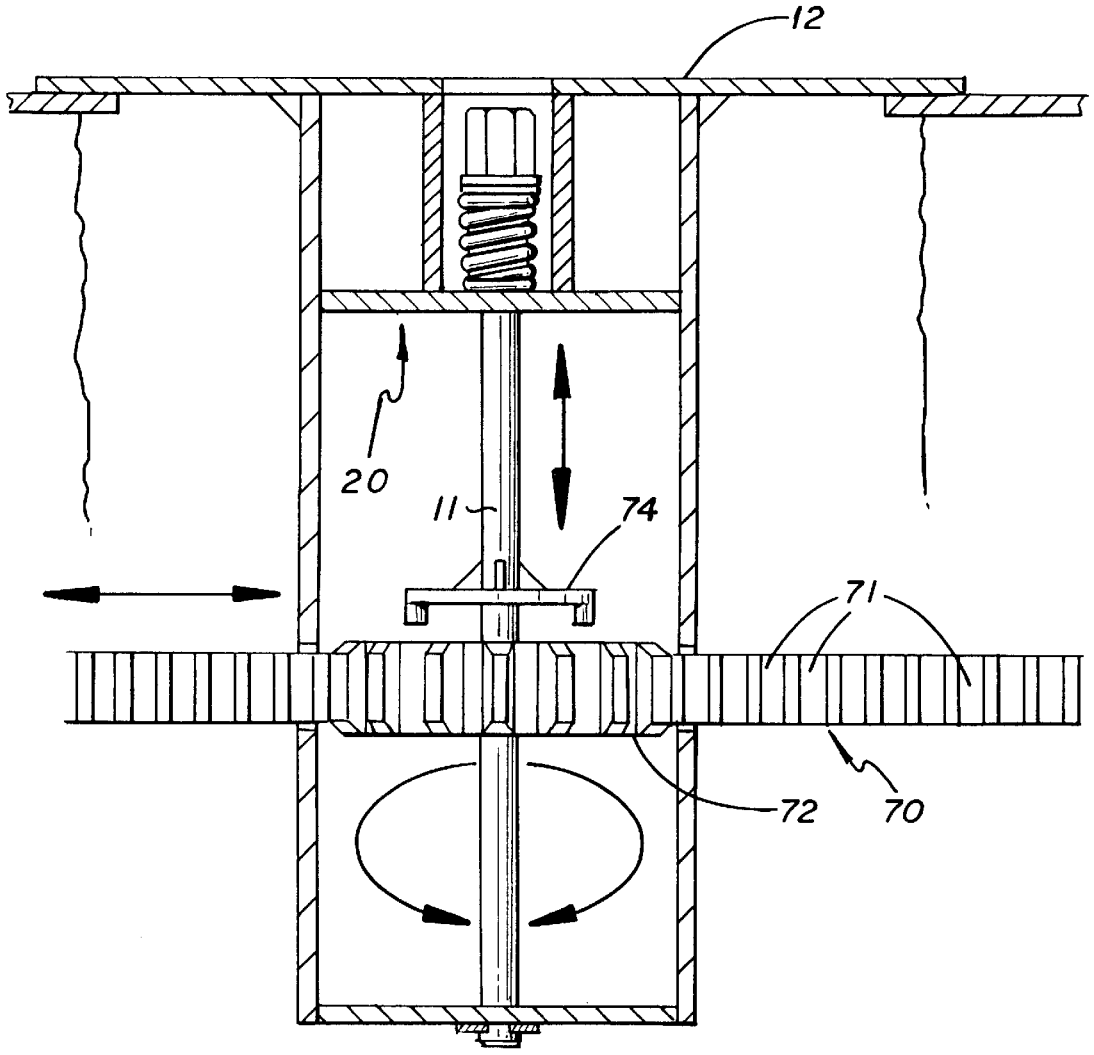
FIG. 7 is a cross-section view of the first embodiment of the invention, showing the arms partially extended by means of a rack and pinion.

Another means for extending the arms is a rack-and-pinion system shown in FIG. 7. Instead of using hinged arms attached to a collar, single link arms are attached to a rack 70 having teeth 71. The teeth 71 of the rack 70 mesh with the teeth 77 of a pinion gear 72 which is coaxial with the rod 11. The rack 70 is substantially perpendicular to the rod 11 and cooperates with the pinion gear 72 to extend the arms in a direction substantially perpendicular to the rod 11. The pinion gear 72 is internally threaded to travel up and down the rod 11. The rod 11 is turned to cause the pinion gear 72 to moved to the desired height. Once the desired height is reached, the clutch spring 74 is activated to drop the clutch gear 74 into place and engage the pinion gear 72. As the rod 11 is turned in a forward position, the clutch causes the pinion gear 72 to rotate and extend the rack 70, so that the arms are forced into the sides of the hole or trench. In a hole where the cavity has undercut the pavement, the arms clamp the cap 12 to the overhanging substrate. When the device is to be removed, the rod 11 is turned in a reverse direction so that the arms retract.

Figure 9:
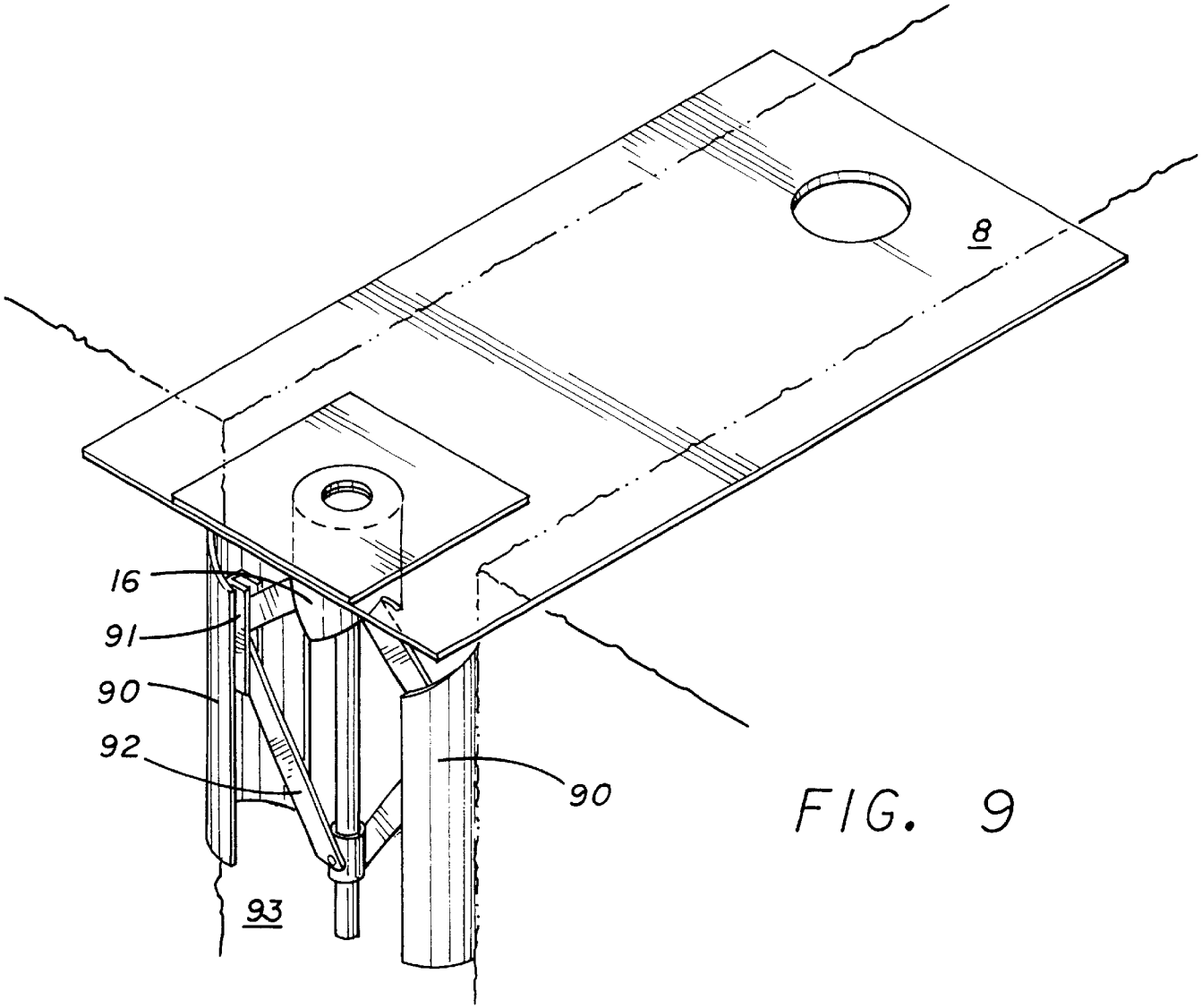
FIG. 9 illustrates a third embodiment of the device employed in a trench, securing cover plates to the ground and shoring trench walls.
Figure 10:
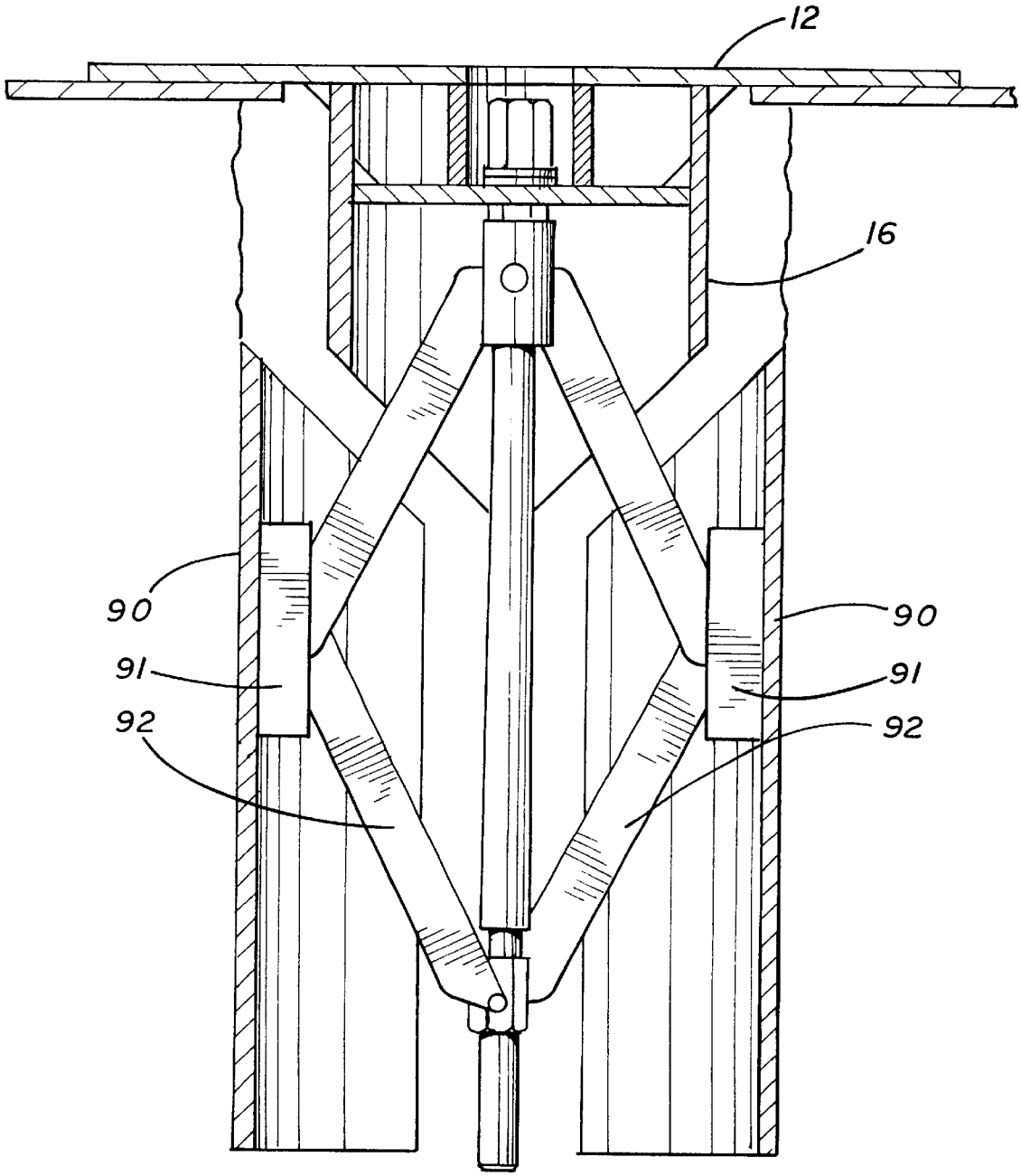
FIG. 10 is a cross-section view of the third embodiment of the invention, showing the arms partially extended by means of a jack screw.

The third embodiment of the invention is shown in FIGS. 9 and 10. The foot is replaced with a plate which can be used to shore up the sides of the trench or hole, as shown in FIGS. 9 and 10. The shoring plates 90 are pivotally attached to a mounting flange 91 of the shoring arms 92 to shore up walls 93 of a trench 9. Preferably the shoring arms 92 are extended by means of a jack screw. The device is installed by inserting the rod 11 into the trench until the cap 12 rests on the ground or pavement, providing support for the device to hang in the cavity. As the rod 11 is turned, the arms extend until the plates abut the walls of the cavity, thereby shoring up the walls.

Preferably the cap 12 and tube 16 are made of material sturdy enough to withstand heavy traffic and weather, preferably steel. The mechanical components, such as the rod, collar, pinion gear, may instead be made of a high-strength, weather resistant material such as nylon or plastic. To prevent the device from being dislodged due to dynamic vibration caused by traffic, a dampening spring may be included between the cap and the arms.

The objects of this invention are achieved through the aforementioned improvements. It will be understood that various modifications may be made to the ground anchor and the method of using it without departing from the purview of the appended claims. Although certain preferred embodiments have been shown and described, it should be understood that other embodiments and modifications that achieve these objects may be apparent to those of skill in the art and are within the scope of the appended claims.

I claim:

1. An anchor for covering an opening in the ground comprising:

a) a cap;

b) a rod having a first end and a second end, the first end floatably connected to the cap;

c) at least one arm connected to the rod below the cap;

d) a foot connected to at least one arm;

e) means for extending at least one arm outwardly from the rod; and f) a tube coaxial with the rod and attached to the cap, the tube having at least one slot parallel to the rod to accommodate the motion of the at least one arm;

wherein the second end of the rod is adapted for positioning into the opening, and at least one arm is adapted for engaging the ground.

2. The anchor according to claim 1 wherein the means for extending at least one arm includes a jack screw.

3. An anchor for covering an opening in the ground comprising:

a) a cap;

b) a rod having a first end and a second end, the first end floatably connected to the cap;

c) at least one arm connected to the rod below the cap;

d) a foot connected to at least one arm; and e) means for extending at least one arm outwardly from the rod including a rack and pinion system;

wherein the second end of the rod is adapted for positioning into the opening, and at least one arm is adapted for engaging the ground.

4. An anchor for covering an opening in the ground comprising:

a) a cap;

b) a rod having a first end and a second end, the first end floatably connected to the cap;

c) at least one arm connected to the rod below the cap;

d) a foot connected to at least one arm;

e) means for extending at least one arm outwardly from the rod; and f) a shoring plate attached to the arm for shoring up a wall of the opening in the ground;

wherein the second end of the rod is adapted for positioning into the opening, and at least one arm is adapted for engaging the ground.

5. An anchor for covering an opening in the ground comprising:

a) a cap;

b) a rod having a first end and a second end, the first end floatably connected to the cap;

c) at least one arm connected to the rod below the cap;

d) a foot connected to at least one arm;

e) means for extending at least one arm outwardly from the rod; and f) a cover plate, disposed under the cap, for covering the opening;

wherein the second end of the rod is adapted for positioning into the opening, and at least one arm is adapted for engaging the ground.

6. An anchor for covering an opening in the ground comprising:

a) a cap;

b) a rod having a first end and a second end, the first end floatably connected to the cap;

c) at least one arm connected to the rod below the cap;

d) a foot connected to the arm;

e) a jack screw for extending at least one arm outwardly from the body;

f) a tube coaxial with the rod and attached to the cap, the tube having at least one slot parallel to the rod to accommodate the motion of at least one arm;

wherein the second end of the rod is adapted for positioning into the opening, and at least one arm is adapted for engaging the ground.

7. The anchor according to claim 6, wherein the cap is larger than the opening in the ground.

8. The anchor according to claim 6, further comprising a cover plate for covering the opening, disposed under the cap.

9. The anchor according to claim 6, further comprising a shoring plate attached to the arm for shoring up a wall of the opening in the ground.

10. An anchor for covering an opening in the ground comprising:

a) a cap;

b) an externally-threaded rod having a first end and a second end, the first end floatably connected to the cap;

c) an internally threaded collar which cooperates with the rod;

d) at least one arm pivotally attached to the collar, wherein turning the rod causes the arm to move from a collapsed position to an extended position;

e) a foot pivotally attached to at least one arm;

f) a tube coaxial with the rod and attached to the cap, the tube having at least one slot parallel to the rod to accommodate the motion of at least one arm;

wherein the rod is adapted for positioning into the opening and turning, and at least one arm is adapted for engaging the ground.

11. An anchor according to claim 10, further comprising at least one arm having a first link and a second link, one end of the first link pivotally connected to the first end of the second link to form a hinge point, the second end of the first link pivotally connected near the cap, the second end of the second link pivotally attached to the collar.

12. An anchor according to claim 10, further comprising at least one arm that is straight, the arm moving to a position substantially parallel to the rod in the collapsed position and substantially perpendicular to the rod in an extended position.

13. An anchor for securing a cover plate over an opening in the ground comprising:

a) a cap;

b) an externally-threaded rod having a first end and a second end, the first end floatably connected to the cap;

c) an internally threaded collar which cooperates with the rod;

d) at least one arm pivotally attached to the collar, wherein turning the rod causes the arm to move from a collapsed position to an extended position;

e) a foot attached to at least one arm;

f) a tube coaxial with the rod and attached to the cap, the tube having at least one slot parallel to the rod to accommodate the motion of at least one arm;

wherein the rod is adapted for positioning into the opening and turning, and at least one arm is adapted for engaging the ground.

14. An anchor according to claim 13, further comprising at least one arm having a first link and a second link, one end of the first link pivotally connected to the first end of the second link to form a hinge point, the second end of the first link pivotally connected near the cap, the second end of the second link pivotally attached to the collar.

15. An anchor according to claim 13, further comprising at least one arm that is straight, the arm moving to a position substantially parallel to the rod in the collapsed position and substantially perpendicular to the rod in an extended position.

16. The anchor according to claim 13, wherein the foot is a shoring plate for shoring up a wall of the opening in the ground.

17. An anchor for securing a cover plate over an opening in the ground comprising:

a) a cap;

b) an externally-threaded rod having a first end and a second end, the first end floatably connected to the cap;

c) an internally threaded collar which cooperates with the rod;

d) a clutch spring which cooperates with a gear clutch;

e) a rack which cooperates with a pinion gear, the pinion gear being coaxial with the rod and engageable by the gear clutch;

f) at least one arm attached to the rack;

g) a tube coaxial with the rod and attached to the cap, the tube having at least one slot parallel to the rod to accommodate the motion of at least one arm;

wherein the rod is adapted for positioning into the opening and turning, and at least one arm is adapted for engaging the ground.

18. The anchor according to claim 17, further comprising a foot that is pivotally attached to the arm.

19. The anchor according to claim 17, further comprising a shoring plate that is attached to the arm, wherein the shoring plate is for shoring up a wall of the opening in the ground.

20. An anchor for covering an opening in the ground comprising:

a) a cap;

b) a rod having a first end and a second end, the first end floatably connected to the cap;

c) at least one arm connected to the rod below the cap;

d) a rack and pinion system for extending at least one arm outwardly from the rod;

wherein the second end of the rod is adapted for positioning into the opening, and at least one arm is adapted for engaging the ground.

21. The anchor according to claim 20, further comprising a shoring plate attached to the arm for shoring up a wall of the opening in the ground.

22. The anchor according to claim 20, further comprising a cover plate for covering the opening, said cover plate disposed under the cap.

23. A method for covering a utility access hole in a street or right of way comprising the steps of:

a) providing an anchor for covering the access hole, the anchor comprising:

(i) a cap;

(ii) a rod having a first end and a second end, the first end floatably connected to the cap; and (iii) at least one arm connected to the rod below the cap, the arm being extendable outwardly from the rod;

b) placing the second end of the rod into the access hole; and c) securing the anchor in the access hole including extending the at least one arm to engage a wall of the access hole.

24. The method of claim 23, wherein the step of extending the at least one arm to engage a wall of the access hole includes activating a jack screw.

25. The method of claim 23, wherein the step of extending at least one arm to engage a wall of the access hole includes activating a rack and pinion system.

26. A method for securing a cover plate over a utility access hole in a street or right of way comprising the steps of:

a) providing an anchor for covering the access hole, the anchor comprising:

(i) a cap;

(ii) a rod having a first end and a second end, the first end floatably connected to the cap; and (iii) at least one arm connected to the rod below the cap and extendable outwardly from the rod;

b) providing a cover plate between the cap and the street or right of way; and c) placing the second end of the rod into the hole; and d) securing the anchor in the access hole including extending at least one arm to engage a wall of the access hole, thereby forming a clamp for securing the cover plate to the street or right of way.

27. The method of claim 26, wherein step b) further comprises placing at least two cover plates between the cap and the ground.

28. The method of claim 26, wherein the step of extending at least one arm to engage a wall of the access hole includes activating a jack screw.

29. The method of claim 26, wherein the step of extending at least one arm to engage a wall of the access hole includes activating a rack and pinion system.

* * * * *